United States Patent [19]

Heinrich

[11] Patent Number: 4,665,376

[45] Date of Patent: May 12, 1987

[54] VIBRATION RESISTANT LINEAR POTENTIOMETER

[75] Inventor: Andrew L. Heinrich, Peoria, Ill.

[73] Assignee: Caterpillar Inc., Peoria, Ill.

[21] Appl. No.: 793,434

[22] Filed: Oct. 31, 1985

[51] Int. Cl.[4] ..... H01C 10/38; H01C 1/12

[52] U.S. Cl. ..... 338/176; 338/182; 338/184

[58] Field of Search ..... 338/96, 99, 169, 170, 338/176, 184, 202, 182

[56] References Cited

U.S. PATENT DOCUMENTS

| | | | |
|---|---|---|---|
| 2,902,663 | 9/1952 | Abatemarco | 338/176 |
| 3,609,623 | 9/1971 | Zdanys et al. | 338/184 |
| 3,732,521 | 5/1973 | Havenstine et al. | 338/202 |
| 3,900,818 | 8/1975 | Berkelhamer et al. | 338/176 |
| 4,047,146 | 9/1977 | Takeyama | 338/184 |
| 4,053,865 | 10/1977 | Brown, Jr. | 338/184 |
| 4,284,969 | 8/1981 | Carbonneau | 338/176 |
| 4,479,107 | 10/1984 | Bleeke | 338/184 |

FOREIGN PATENT DOCUMENTS 1053475 1/1967 United Kingdom .

*Primary Examiner*—Robert L. Spruill
*Assistant Examiner*—Donald R. Studebaker
*Attorney, Agent, or Firm*—Stephen L. Noe

[57] ABSTRACT

Linear potentiometers are commonly used as position sensors on various mechanical devices. Such potentiometers are frequently subjected to extreme vibratory excitation, which is known to cause premature failure. The subject potentiometer includes a housing having interior walls defining a cavity. First and second guide slots are linearly disposed along the cavity walls parallel to the housing. A wiper block is positioned and is axially movable within the cavity. The wiper block includes first and second slide rails linearly disposed along the wiper block and extending outwardly from the wiper block at a location sufficient to project into respective ones of the guide slots. Each of the first and second slide rails has a plurality of tapered engaging portions positioned adjacent respective surfaces of the guide slots.

10 Claims, 4 Drawing Figures

VIBRATION RESISTANT LINEAR POTENTIOMETER

DESCRIPTION

1. Technical Field

This invention relates generally to potentiometers and, more particularly, to vibration resistant linear potentiometers.

2. Background Art

Potentiometers are frequently used as position sensors in various types of electrical control circuits. In particular, linear potentiometers are useful to translate mechanical motion into responsive electrical signals. Linear, as used in this specification, refers to the mechanical direction of travel of the potentiometer slider as opposed to the electrical taper of the resistive element within the potentiometer.

In such applications, it is necessary that the sliding element of the potentiometer move freely and smoothly without binding. Various potentiometers on the market today satisfy this requirement. However, when used in an industrial environment, potentiometers are often subjected to substantial amounts of vibration and shock loading. For example, a potentiometer used as a fuel rack position sensor on a diesel engine is continually subjected to the normal engine vibration. It has been found that vibration of this nature can establish resonant vibration of the contact element within the potentiometer. Such resonant vibration can damage the contact element and/or resistive element of the potentiometer, resulting in failure or loss of accuracy owing to rapid degradation of the potentiometer.

Previous attempts to provide a potentiometer having a freely movable sliding element that is not sensitive to mechanical vibration have not been fully successful. For example, U.S. Pat. No. 3,732,521, issued on May 8, 1973, to Havenstine et al discloses a potentiometer having a rib in an interference fit with two collars. The interference fit intentionally produces frictional drag to reduce the possibility of linear movement during periods of vibration. Such frictional drag is undesirable in a potentiometer, and necessarily limits its usefulness. In addition, no provision is made to protect the potentiometer from vibratory effects other than linear movement. Likewise, U.S. Pat. No. 3,900,818, issued on Aug. 19, 1975, to Berkelhamer et al discloses a linear potentiometer having a spring loaded slider element to provide positive contact between a collector plate and the resistance element within the potentiometer. Such spring loading really does nothing to dampen vibratory effects once the resonant frequency of the combined elements is realized.

The present invention is directed to overcoming one or more of the problems as set forth above.

DISCLOSURE OF THE INVENTION

In one aspect of the present invention, a linear potentiometer having an elongated housing with first and second end portions and an intermediate portion is provided. The intermediate portion has interior walls defining a cavity, and a plurality of guide slots linearly disposed along the interior walls parallel to the axis of the housing. A wiper block is positioned and is axially movable within the cavity. A plurality of slide rails are linearly disposed along the wiper block, each of the slide rails extending outwardly from the wiper block and being positioned at a location sufficient to project into respective ones of the guide slots. Each of the slide rails has a plurality of tapered engaging portions positioned adjacent respective guide surfaces of the guide slots.

The present invention provides a linear potentiometer wherein the wiper block is smoothly movable in a linear direction, while being inherently vibration resistant.

BRIEF DESCRIPTION OF THE DRAWINGS

For a better understanding of the present invention, reference may be made to the accompanying drawings, in which.

BEST MODE FOR CARRYING OUT THE INVENTION

Figure 1:
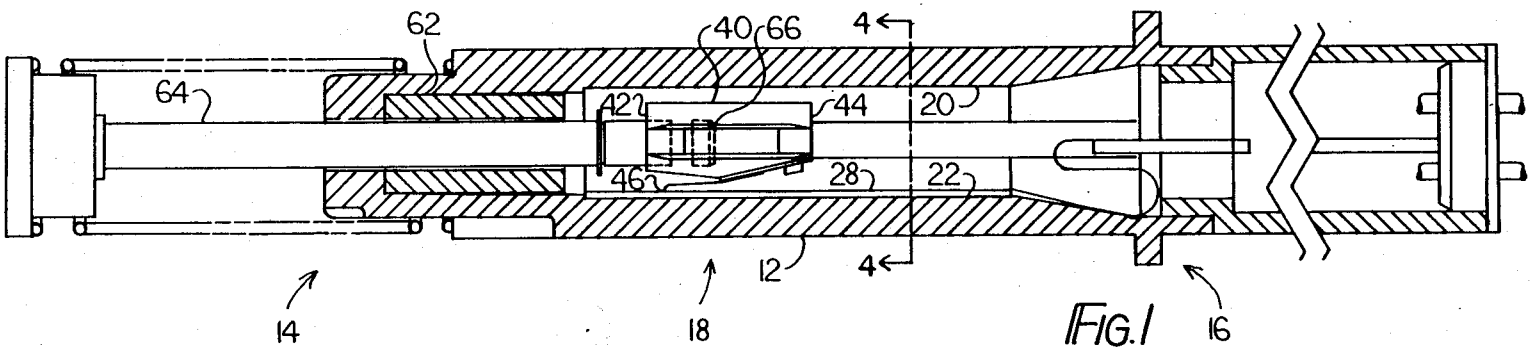
FIG. 1 is a sectional view of a linear potentiometer incorporating one embodiment of the present invention.

Referring now to the drawings, a potentiometer embodying certain of the principles of the present invention is generally indicated by the reference numeral 10. It should be understood that the following detailed description relates to the best presently known embodiment of the potentiometer 10. However, the potentiometer 10 can assume numerous other embodiments, as will become apparent to those skilled in the art, without departing from the appended claims.

The potentiometer 10 includes an elongated housing 12 having first and second end portions 14,16 and an intermediate portion 18. The intermediate portion 18 includes a cavity defined by a top wall 20, a bottom wall 22, and first and second side walls 24,26. A resistance element 28 is disposed along one of the top and bottom walls 20,22. Each of the first and second side walls 24,26 has a respective linear guide slot 30,30' disposed parallel to the axis of the elongated housing 12. Each of the guide slots 30,30' has a respective top guide surface 34,34', bottom guide surface 36,36', and outer side guide surface 38,38'. In the preferred embodiment, the guide slots 30,30' are disposed substantially opposite one another along the intermediate portion first and second side walls 24,26.

A wiper block 40 has first and second ends 42,44. The wiper block 40 is positioned within the cavity and is axially movable between the housing first and second end portions 14,16. An electrical contact element 46 is positioned on the wiper block 40 at a location sufficient to engage the resistance element 28.

First and second slide rails 48,48' are linearly disposed along the wiper block 40 between the wiper block first and second ends 42,44. The first and second slide rails 48,48' each extend outwardly from the wiper block 40 and are positioned at a location sufficient to project into respective ones of the guide slots 30,30'. Each of the first and second slide rails 48,48' has a respective top engaging portion 50,50', bottom engaging portion 52,52', and outer side engaging portion 54,54', positioned adjacent respective ones of the guide slot top, bottom, and outer side guide surfaces 34,34',36,36',38,38'. The first and second slide rails 48,48' each have a first and second end 56,56',58,58' and an intermediate portion 60,60'. Each of the tapered engaging portions 50,50',52,52',54,54' has a maximum cross-sectional thickness along the respective slide rail intermediate portion 60,60' and tapers to a minimum cross-sectional thickness at each of the respective slide rail ends 56,56',58,58'.

The potentiometer 10 also includes a sleeve bearing 62 axially located in one of the housing first and second end portions 14,16, and a shaft 64 having an end 66 connected to one of the wiper block first and second ends 42,44. The shaft 64 passes axially through the sleeve bearing 62. In the preferred embodiment, the sleeve bearing 62 is manufactured from a self-lubricating polymer, for example, a glass, silicon, and PTFE, filled polyphenylene sulfide resin. In addition, in the preferred embodiment, at least one of the housing intermediate portion 18 and slide rails 48,48' are manufactured from a similar self-lubricating polymer.

Figure 2:
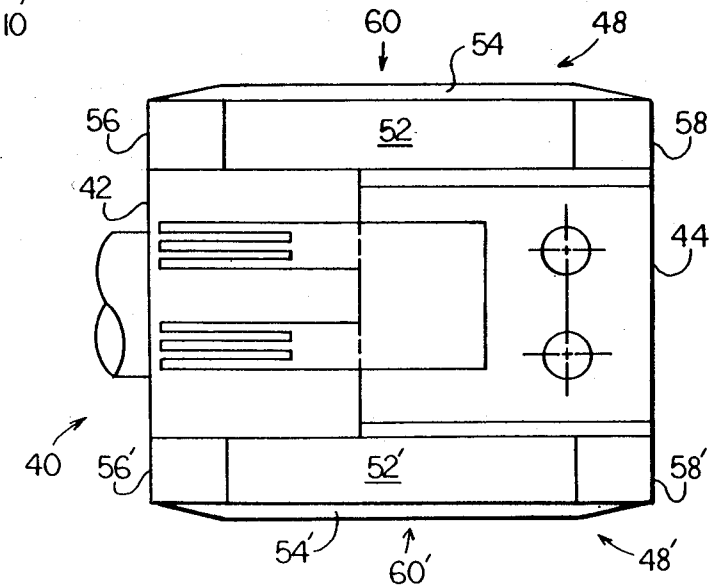
FIG. 2 is a plan view of a wiper block used in one embodiment of the present invention.
Figure 3:
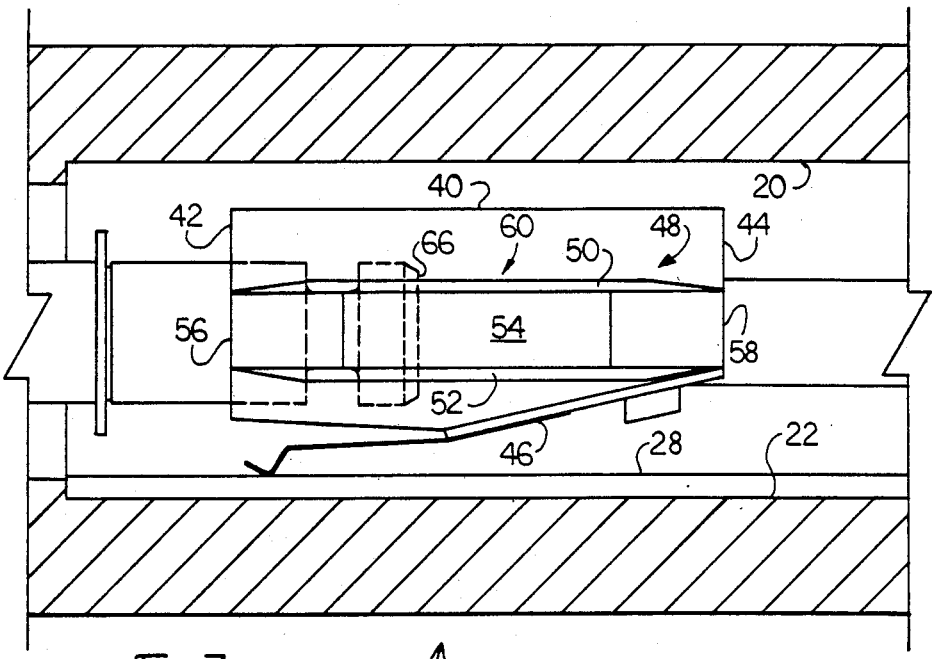
FIG. 3 is an enlarged partially sectioned view of a portion of the linear potentiometer shown in Fig. 1.
Figure 4:
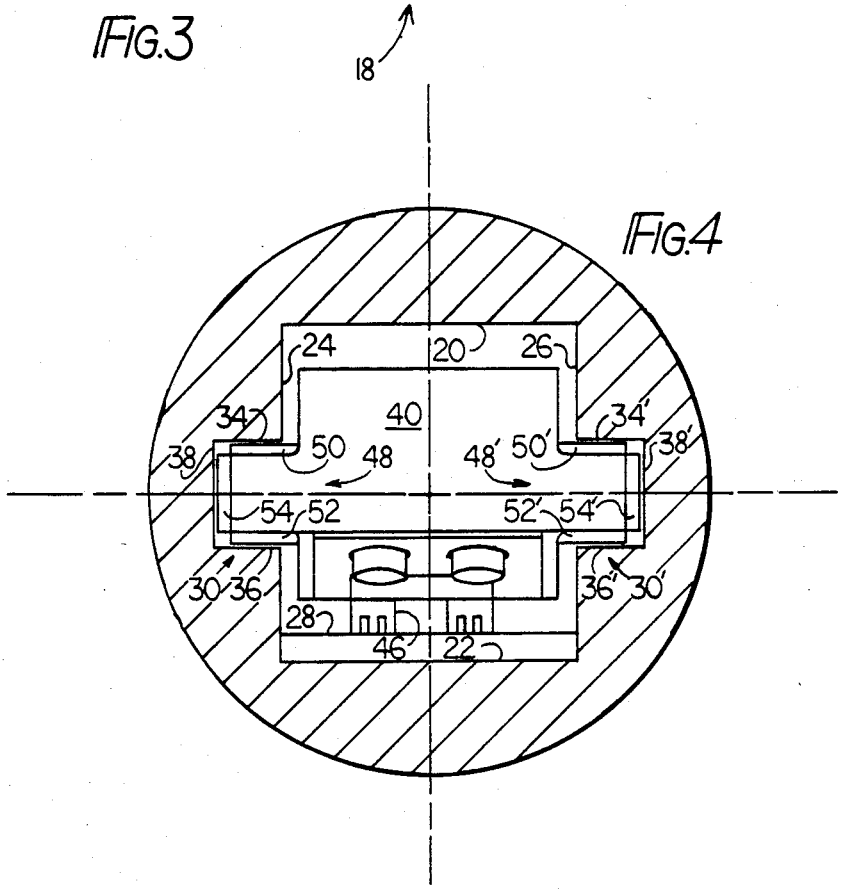
FIG. 4 is a sectional end view showing the wiper block of FIG. 2 positioned within a potentiometer housing.

The tapered engaging portions 50,50',52,52',54,54' located on the first and second slide rails 48,48' of the wiper block 40 can be seen particularly well in FIGS. 2 and 4. In FIG. 2, the tapered cross-section can be seen to be relatively thinnest at the wiper block first and second ends 42,44 and relatively thickest intermediate the wiper block first and second ends 42,44. In the preferred embodiment, the nominal clearance provided between each of the guide slot guide surfaces 34,34',36,36',38,38' and the respective slide rail top, bottom, and outer side engaging portions 50,50',52,52',54,54' is less than 0.003 inches (0.075 millimeters).

Other common elements of a typical linear potentiometer are shown in FIG. 1, for example, a compression spring and electrical contact elements, but form no part of the present invention and are not discussed in further detail. Such basic potentiometer elements are well-known in the art.

Industrial Applicability

Operation and use of the potentiometer 10 is straightforward, and is best described in conjunction with FIG. 1. In response to linear motion of the shaft 64, the wiper block 40 is caused to move axially between the housing first and second end portions 14,16. Responsively, the electrical contact element 46 is moved along the resistance element 28 and a responsive electrical resistance signal is provided from the electrical contact elements associated with the potentiometer 10.

The wiper block 40 is guided axially within the housing cavity by the combination of the guide slots 30,30' and the slide rails 48,48'. Owing to the relatively small nominal clearance between the guide slot guide surfaces 34,34',36,36',38,38' and respective slide rail engaging portions 50,50',52,52',54,54', external vibration applied to the potentiometer 10 is unable to establish a corresponding resonant vibration in the wiper block 40. Consequently, the electrical contact element 46 remains in proper contact with the resistance element 28 and a stable position signal is delivered from the potentiometer 10. Advantageously, despite the near interference fit between the guide slots 30,30' and slide rails 48,48', the wiper block 40 moves freely within the cavity owing primarily to the tapered configuration of the slide rail engaging portions 50,50',52,52',54,54'. In addition, the self-lubricating nature of the polymer used to manufacture at least one of the housing intermediate portion 18 and slide rails 48,48' aids in providing smooth operation of the potentiometer assembly.

The embodiment of the invention described above provides a linear potentiometer having low resistance to linear motion while simultaneously being essentially free from deleterious effects of external vibration. Such advantage is accomplished in a potentiometer suitable for mass production and without resort to the expense of custom manufacturing.

Other aspects, objects, advantages, and uses of this invention can be discerned from a study of the drawings, the disclosure, and the appended claims.

I claim:

1. A potentiometer having an electrical contact element engageable with a resistance element, comprising:

an elongated housing having first and second end portions and an intermediate portion, said intermediate portion having a cavity defined by a top wall, a bottom wall, and first and second side walls, each of said side walls having a linear guide slot disposed parallel to the axis of said elongated housing, each of said guide slots having a respective top, bottom, and outer side guide surface;

a wiper block having first and second ends, said wiper block being positioned within said cavity and being axially movable between said housing first and second end portions; and first and second slide rails each linearly disposed along said wiper block between said wiper block first and second ends, said first and second slide rails each extending outwardly from said wiper block and being positioned at a location sufficient to project into respective ones of said guide slots, each of said first and second slide rails having a plurality of tapered engaging portions each positioned adjacent a respective one of said guide slot top, bottom, and outer side guide surfaces.

2. A potentiometer, as set forth in claim 1, wherein each of said first and second slide rails has first and second ends and an intermediate portion, and each of said tapered engaging portions has a maximum thickness along said respective slide rail intermediate portion, and tapers to a minimum thickness at each of said respective slide rail ends.

3. A potentiometer, as set forth in claim 2, wherein said guide slots are disposed substantially opposite one another along said intermediate portion first and second side walls.

4. A potentiometer, as set forth in claim 3, wherein said resistance element is linearly disposed along one of said housing top and bottom walls, and said electrical contact element is positioned on said wiper block at a location sufficient to engage said resistance element.

5. A potentiometer, as set forth in claim 1, including a sleeve bearing axially located in one of said housing first and second end portions, and a shaft having an end connected to one of said wiper block first and second ends said shaft passing axially through said sleeve bearing.

6. A potentiometer, as set forth in claim 5, wherein said sleeve bearing is manufactured from a self-lubricating polymer.

7. A potentiometer, as set forth in claim 6, wherein at least one of said housing intermediate portion and said slide rails are manufactured from a self-lubricating polymer.

8. A potentiometer, as set forth in claim 1, wherein the nominal clearance between each of said guide slot guide surfaces and the respective one of said slide rail top, bottom, and outer side engaging portions is less than 0.003 inches.

9. A potentiometer having an electrical contact element engageable with a resistance element, comprising:

an elongated housing having first and second end portions and an intermediate portion, said intermediate portion having interior walls defining a cavity;

a plurality of guide slots linearly disposed along said intermediate portion interior walls parallel to the axis of said elongated housing, each of said guide slots having a respective top, bottom, and outer side guide surface;

a wiper block having first and second ends, said wiper block being positioned within said cavity and being axially movable between said housing first and second end portions; and a plurality of slide rails linearly disposed along said wiper block between said wiper block first and second ends, each of said slide rails extending outwardly from said wiper block and being positioned at a location sufficient to project into respective ones of said guide slots, each of said slide rails having a respective top, bottom, and outer side engaging portion positioned adjacent a respective one of said top, bottom, and outer guide surfaces of said guide slots, each of said slide rail top, bottom, and outer side engaging portions being of varied cross-section along the length of said respective rail portion, said cross-section being relatively thinnest at said wiper block first and second ends and relatively thickest intermediate side wiper block first and second ends.

10. A potentiometer, comprising:

an elongated housing having first and second end portion and an intermediate portion, said intermediate portion having interior walls defining a cavity;

a resistance element linearly disposed along said intermediate portion interior walls;

first and second guide slots linearly disposed substantially opposite one another along said intermediate portion interior walls parallel to said elongated housing, each of said guide slots having a respective top, bottom, and outer side guide surface;

a wiper block having first and second ends, said wiper block being positioned within said cavity and being axially movable between said housing first and second end portions;

an electrical contact element positioned on said wiper block at a location sufficient to engage said resistance element;

first and second slide rails each having first and second ends and an intermediate portion and being linearly disposed along said wiper block between said wiper block first and second ends, said first and second slide rails each extending outwardly from said wiper block and being positioned at a location sufficient to project into respective ones of said guide slots, each of said first and second slide rails having a plurality of tapered engaging portions each positioned adjacent a respective one of said guide slot top, bottom, and outer side guide surfaces, each of said tapered engaging portions having a maximum thickness along said respective slide rail intermediate portion and tapering to a minimum thickness at each of said respective slide rail ends;

a sleeve bearing axially located in one of said housing first and second end portions; and a shaft having an end connected to one of said wiper block first and second ends, said shaft passing axially through said sleeve bearing.

* * * * *